United States Patent [19]

Guier

[11] 4,326,745

[45] Apr. 27, 1982

[54] LINK CONTROL SYSTEM FOR USE WITH DUAL ELEVATORS

[75] Inventor: William C. Guier, Tulsa, Okla.

[73] Assignee: Guier and Affiliates, Inc., Tulsa, Okla.

[21] Appl. No.: 164,002

[22] Filed: Jun. 30, 1980

[51] Int. Cl.[3] ..... E21B 19/02

[52] U.S. Cl. ..... 294/90; 24/249 DP; 414/22

[58] Field of Search ..... 414/22, 745; 294/82, 294/90, 102 A; 175/85; 24/249 DP

[56] References Cited

U.S. PATENT DOCUMENTS

| | | | |
|---|---|---|---|
| Re. 29,995 | 5/1979 | Guier | 24/249 DP X |
| 3,063,509 | 11/1962 | Guier | 414/22 X |
| 3,368,699 | 2/1968 | Scaggs | 414/22 |
| 3,498,586 | 3/1970 | Turner | 294/90 X |
| 3,526,425 | 9/1970 | Langowski et al. | 414/22 X |
| 3,857,450 | 12/1974 | Guier | 175/85 |

*Primary Examiner*—Leslie J. Paperner

*Attorney, Agent, or Firm*—Head & Johnson

[57] ABSTRACT

An improved apparatus for handling strings of drill pipe in a drilling rig including a lift member elevationally positionable over a borehole, a pair of links pivotally supported at their upper ends to the lifting member and having open loops at their upper ends to the lifting member and having open loops at their lower ends, cable means extending from the drill rig floor to upward attachment providing means to guide the lifting means and thereby the link in vertical alignment relative to the borehole, a cylinder-piston extending from the lifting member to the links so that the lower ends thereof can be remotely controlled to and move towards or away from each other; and a second cylinder extending from the lifting member to selectively pivot the links in a common plane from the vertical to an inclined angle.

7 Claims, 10 Drawing Figures

3

3

LINK CONTROL SYSTEM FOR USE WITH DUAL ELEVATORS

CROSS-REFERENCE TO RELATED PATENT

This application is related to the Guier U.S. Pat. No. 3,063,509 dated Nov. 13, 1962 entitled "APPARATUS FOR HANDLING STRANDS OF PIPE" and to Guier U.S. Pat. No. Re. 29,995 entitled "DUAL ELEVATORS", dated May 15, 1979. Both U.S. Pat. Nos. 3,063,509 and Re. 29,995 are inserted by reference into this application.

BACKGROUND OF THE INVENTION

1. Field of the Invention

This invention is related to oil well drilling apparatus and, more particularly, to apparatus for handling the strings of drill pipe utilized for drilling oil and gas wells. Most particularly, the invention is directed towards improved means of handling dual elevators for use in tripping drill pipe into and out of a borehole.

2. Description of the Prior Art

A significant improvement in the art of drilling oil and gas wells is revealed in Guier U.S. Pat. No. 3,063,509 which, as above indicated, is incorporated herein by reference. In this patent, handling drill pipe utilizing a dual elevator system is provided. A primary advantage of the dual elevator system is that it eliminates the use of slips; and by eliminating the use of slips, the life of the drill pipe is substantially increased. The present invention is directed towards improved means of controlling the links of a drilling system for more precisely coupling and uncoupling the links from dual elevators.

It is therefore an object of this invention to provide an improved apparatus for handling stands of pipe in a drilling rig.

These general objects as well as other and more specific objects of the invention will be fulfilled in the following description and claims, taken in conjunction with the attached drawings.

SUMMARY OF THE INVENTION

An improved apparatus for handling stands of pipe in a drilling rig is provided. The apparatus is particularly applicable for use with a dual elevator system in which a pair of elevators are slidably positioned on a guide means adjacent a borehole. The invention provides apparatus for controlling links so that they can be remotely controlled to couple to and uncouple from the elevators to thereby enable drilling operators to run strings of drill pipe into and out of boreholes more expeditiously. The improved apparatus includes a lifting member which is elevationally positionable in a drilling rig over a borehole. A pair of links is pivotally supported at their upper ends to the lifting member, the links being spaced apart and generally parallel to each other, the links having open loops at their lower ends. Brackets are pivotally affixed to the lifting member and extend downwardly adjacent the pair of links. The brackets are coupled to the links. An air or hydraulic cylinder piston is employed to pivotally move the brackets relative to the lifting member so that the links may be swung in a common plane from the vertical. Extending from the bracket is a linkage system having linkages which engage each of the links. A piston cylinder controls the linkage so that the lower end of the links may be moved towards and away from each other.

A pair of cables is attached at their lower end to the drilling floor and are supported from the upper portion of the rig to provide vertical guide means for the lifting member and thereby the links. The apparatus must provide means whereby a drilling operator may remotely control the links for use with a dual elevator system for more efficient, dependable, and rapid movement of strings of drill pipe.

DESCRIPTION OF THE VIEWS

DETAILED DESCRIPTION

Figure 1:
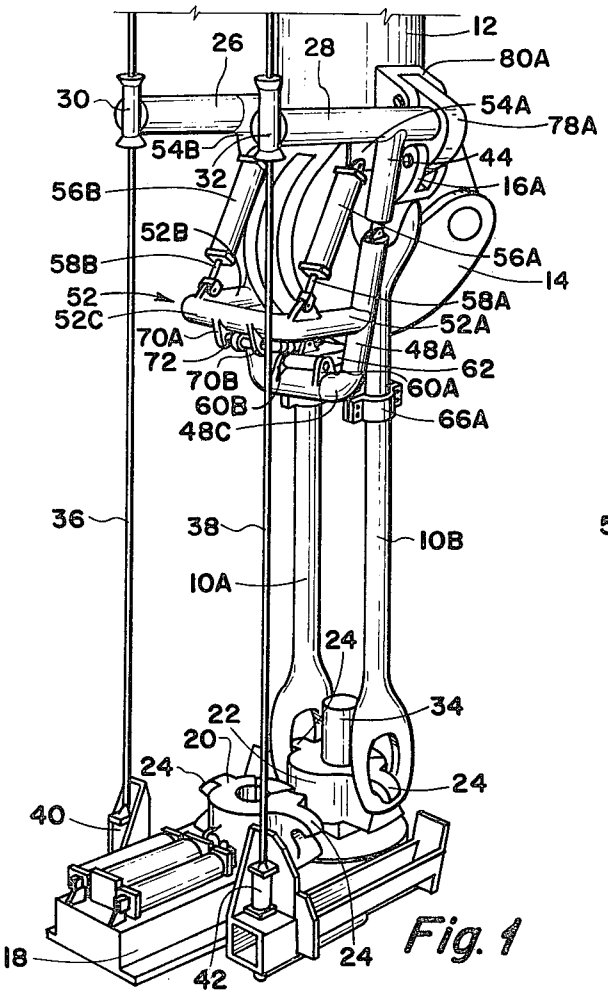
FIG. 1 is an isometric view of a small portion of a drilling rig and disclosing one embodiment of the present invention.

Referring to the drawings and first to FIG. 1, an isometric view of an embodiment of the invention is illustrated. The object of the invention is to provide apparatus for accurately controlling links 10A and 10B. The use of links in drilling oil and gas wells is well known. The links are supported at their upper ends to a lifting member or hook 12. Above the lifting member 12 and not shown since it is standard drilling technology, is an apparatus for elevationally positioning the lifting member which is usually in the form of a block having a plurality of parallel pulleys which are supported by a cable extending from a crown block in the upper end of the derrick. By controlling the length of the cable interconnecting the crown block and pulleys, the elevation of the lifting member 12 is provided.

Figure 2:
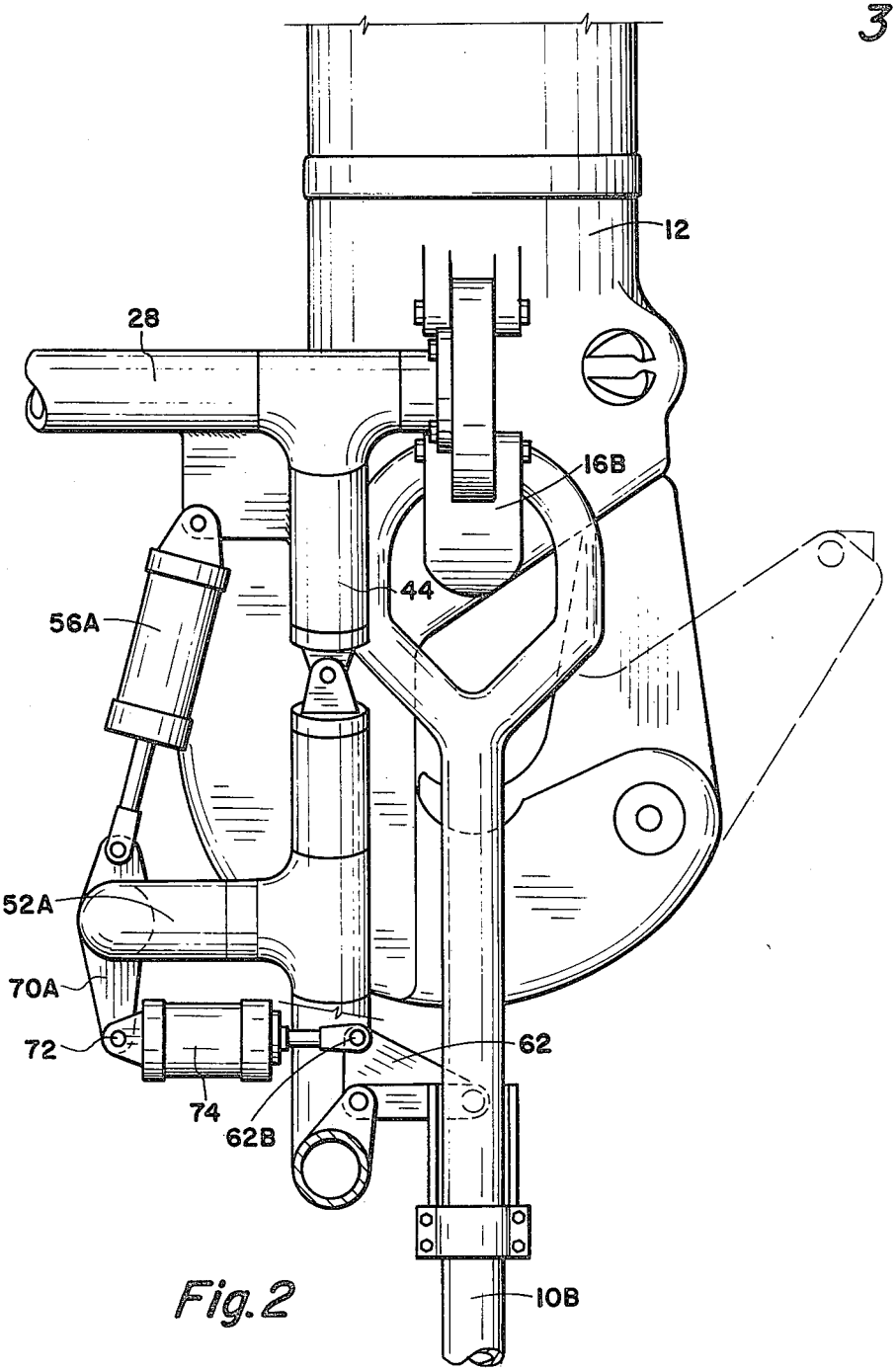
FIG. 2 is an enlarged elevational side view of a lifting member as employed in a drilling rig and including the upper portions of a pair of links and showing the mechanism employed for shifting the links.
Figure 3:
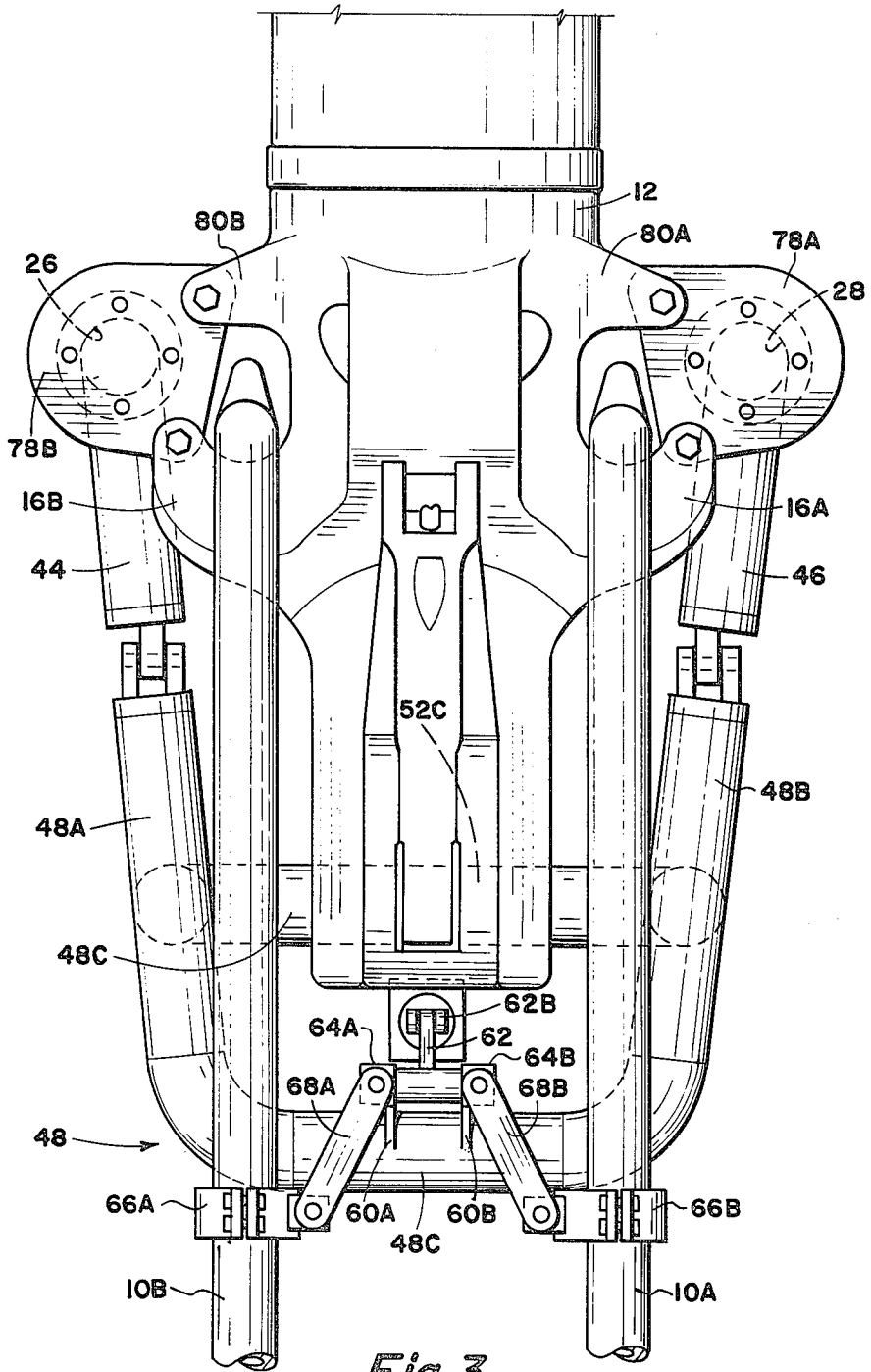
FIG. 3 is a front elevational view of the lower portion of a lifting member and the upper portion of links showing the means illustrated in FIG. 2 for shifting the links.

As shown in FIG. 3, the lifting member 12 includes integral opposed ears 16A and 16B which receive the upper end of links 10A and 10B. In the usual fashion, the upper end of each of the links includes a closed loop as shown in FIG. 2, and, in like manner, the lower end of the links includes a closed loop as shown in FIG. 1. The function of this invention is to provide means to shift the lower ends of the links, one reason being to permit the ready attachment to and detachment from dual elevators. Reference has previously been made to Guier U.S. Pat. No. 3,063,509 which introduced the dual elevator system to the petroleum industry. As shown in FIG. 1, a horizontal elevator guide is generally indicated by the numeral 18. Slidably positioned on the elevator guide is a pair of elevators, indicated by the numerals 20 and 22. Each of the elevators 20 and 22 includes integral horns 24 extending from opposite sides of the elevator. The lower closed loops of the links 10A and 10B engage the elevator horns 24 for lifting from the elevators.

Affixed to the lifting member 12 are two opposed horizontal bars 26 and 28. At the outer end of each of the bars is a cable guide 30 and 32, which may be tubular as shown, or may be in the form of pulleys or rollers.

Extending from the rig floor is a pair of cables 36 and 38. The upper end of the cables are attached to portions of the drilling rig derrick, such not being shown since the derrick is not a part of this invention and is standard drilling technology. The cables 36 and 38 extend vertically in the drilling rig. A preferred arrangement includes means of selectably applying tension or slack to the guidelines 36 and 38. This is accomplished by use of a pair of cylinder-pistons 40 and 42. The cylinders are supported to the elevator guide frame 18. The upper end of the piston rods extending from cylinder-pistons 40 and 42 are attached to the guidelines 36 and 38. When hydraulic pressure is applied to withdraw the piston rods, tension is applied to the lines 36 and 38, and when the piston rods are extended, slack is provided in the lines. When tension is applied to the guidelines the lifting means 12 and links 10A and 10B move vertically over the borehole.

The elevator guide 18 is positioned on the rig floor which is adjacent a borehole, the borehole not being seen but being in the position wherein it receives a length of drill pipe, the upper tool end 34 of which is shown in FIG. 1.

Extending downwardly from bar 28 is a short vertical member 44 and, in like manner, extending downwardly from bar 26 is a short vertical member 46 (see FIG. 3). Pivotally attached at the lower end to the vertical members 44 and 46 is a U-shaped member generally indicated by the numeral 48. The U-shaped member has opposed leg portions 48A and 48B and an intermediate, generally horizontal portion 48C. The upper ends of the leg portions 48A and 48B are pivotally connected to the lower ends of downwardly extending members 44 by pins 50 (see FIG. 6). A horizontal U-shaped member generally indicated by the numeral 52 is formed by legs 52A and 52B and horizontal intermediate portion 52C. The ends of the legs 52A and 52B are affixed to the first U-shaped member legs 48A and 48B so as to extend generally perpendicular to the first U-shaped member.

Reinforcing plates 54A and 54B are provided at the intersection of bars 26 and 28 and the downwardly extending members 44. Positioned between plates 54A and 54B and the horizontal U-shaped member 52 is a pair of cylinder-pistons 56A and 56B. Each of the cylinder-pistons has a piston rod 58A and 58B reciprocally extending therefrom. The lower end of the rods are attached to the outer end of the horizontal U-shaped member leg portions 52A and 52B. By the extension or retraction of piston rods 58A and 58B, the first U-shaped member 48 is pivoted relative to lifting member 12.

Affixed to the first U-shaped member intermediate portion 48C are parallel beckets 60A and 60B. A triangular member 62 has three pivot points 62A, 62B, and 62C. Pivot point 62A is rotatably attached between beckets 60A and 60B.

As shown best in FIG. 3, the triangular member pivot points 62C, that is, the outer end of the triangular member, has pivotally attached to it opposed blocks 64A and 64B. Clamps 66A and 66B are attached to links 10B and 10A respectively. Extending between the block 64A and clamp 66A is a link 68A and, in like manner, link 68B extends from block 64B to claim 66B. The links are pivoted at each end.

Figure 6:
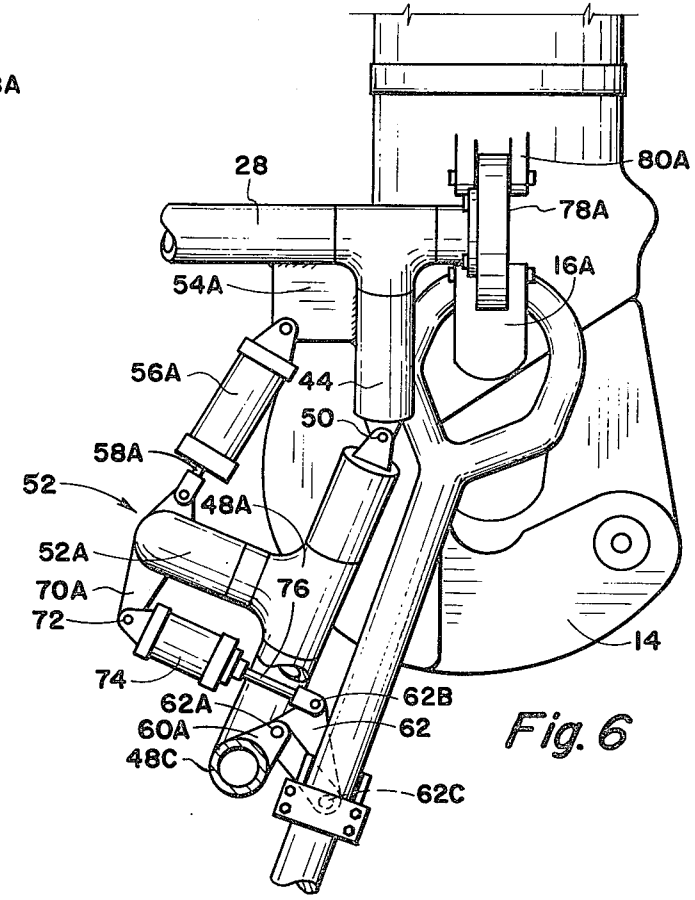
FIG. 6 is a side elevational view as shown in FIGS. 2 and 4 but showing the cylinder-piston operated to swing the links in a common plane relative to the vertical.

Referring to FIGS. 1 and 6, it can be seen that downwardly extending from the horizontal U-shaped member intermediate portion 52 are a pair of spaced apart parallel brackets 70A and 70B. A shaft 72 extends between the brackets 70A and 70B and supports one end of a piston-cylinder 74. Reciprocally extending from the cylinder-piston 74 is a piston rod 76 which, at its outer end is pivotally connected to the triangular member pivot point 62B. When piston rod 76 is hydraulically withdrawn, triangular member 62 is pivoted to the position shown in FIG. 2 in which case the links 10A and 10B extend parallel to each other as shown in FIG. 3.

Figure 5:
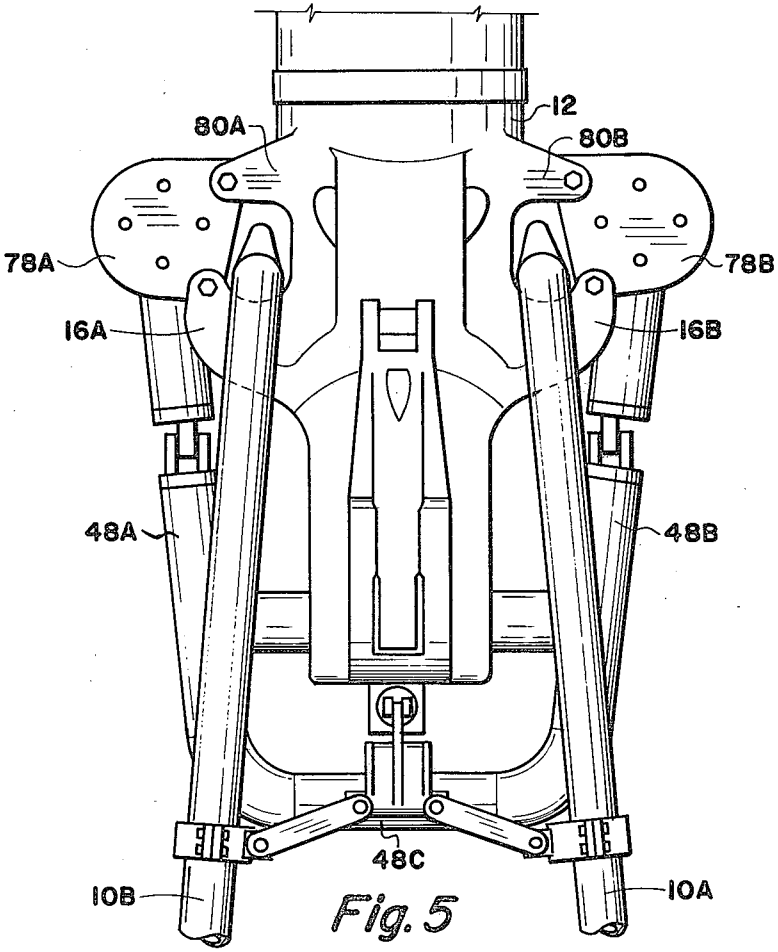
FIG. 5 is a view as shown in FIG. 3 but showing the links shifted so that the lower ends thereof are spread apart.
Figure 4:
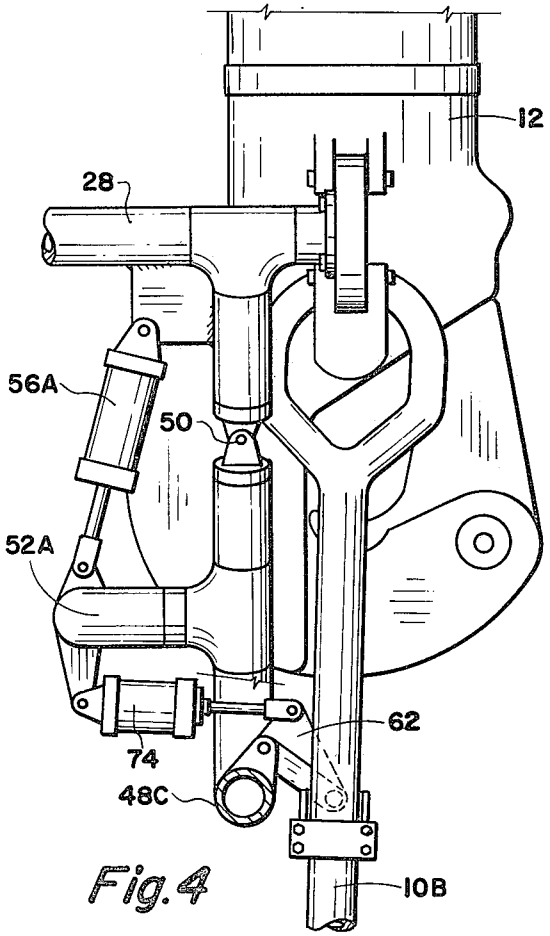
FIG. 4 is a partial side elevational view as shown in FIG. 2 but showing the cylinder-piston operated to shift the links apart.

When the piston rod 76 is extended, as shown in FIG. 4, the triangular member 62 is pivoted downwardly, and links 68A and 68B push the links apart as shown in FIG. 5. Thus by controlling hydraulic pressure to the cylinder-piston 74 the lower ends of the links may be moved towards or away from each other to engage or disengage the horns 24 of elevators 20 and 22.

To shift the links 10A and 10B from their downwardly inclined vertical position so as to permit the links to be moved to alignment with elevators 20 and 22 resting on elevator guide 18, hydraulic pressure is applied to cylinder-pistons 56A and 56B to withdraw piston rods 58A and 58B. When the piston rods are withdrawn, the assembly formed by the U-shaped members 48 and 52 is pivoted rearwardly to a position as shown in FIG. 6. This pivots the links rearwardly as shown in FIG. 6. In this manner, the links can be remotely controlled by the use of hydraulic pressure to maintain the links in vertical parallel position, spread the links apart, or draw them together, or pivot them rearwardly relative to the vertical.

The inner end of bars 26 and 28 are affixed to plates 78A and 78B. The plates in turn are secured to the lifting member ears 16A and 16B. Spaced above ears 16A and 16B and extending from the lifting member 12 are link retainers 80A and 80B. The plates 78A and 78B are retained between the ears 16A and 16B and the link retainers 80A and 80B. To remove the link shift mechanism from the lifting member 12, all that is necessary is to remove the plates 78A and 78B and the clamps 66A and 66B from the links. An important advantage of this arrangement is that the lifting member 12 is a standard item utilized in the drilling industry. To retain the upper loops of the links 10A and 10B in contact with ears 16A and 16B, a linkage (not shown) is normally attached at the outer ends of the ears 16A and 16B and to the link retainers 80A and 80B. Thus this invention provides means of utilizing a standard lifting member and standard links 10A and 10B in an arrangement wherein the lifting member and links may be readily adapted to provide means to shift the links without requiring any modification to the lifting member and links.

Referring to FIGS. 7, 8, 8A and 9, an alternate embodiment of the invention is shown. The invention utilizes a lifting member or hook 12, which, as has been previously indicated, is a standard item of equipment utilized in oil and gas well drilling. Plates 78A and 78B extend between the lifting member ears 16A and 16B and link retainers 80A and 80B as has previously been described. Affixed to and extending rearwardly from the plates 78A and 78B are a pair of spaced apart brackets generally indicated by the numerals 82A and 82B. Each of the brackets is L-shaped having a horizontal portion and at the outer end thereof, a downward extending portion. Affixed to the outer end of the horizontal portion are cable guides 30 and 32 as previously described which remove guidelines 36 and 38.

Supported below the L-shaped brackets 82A and 82B is a horizontal base member 84. Pivotally affixed at the lower end of the vertical portions of brackets 82A and 82B are suspension bars 86A and 86B which are also pivotally attached at their lower ends to base member 84. Thus the base member 84 is pivotally supported to brackets 82A and 82B.

The base member 84 includes a radial portion 84A extending in the direction of and intermediate the links. Pivotally affixed at the opposed outer ends of the base portions 84 are a pair of horizontal arms 88A and 88B (see FIGS. 8 and 8A). Affixed to the links 10A and 10B are clamps 66A and 66B as previously described. The outer end of arms 88A and 88B are pivotally attached to clamp 66A and 66B.

Pivotally attached at an intermediate point to the outer end of the base member integral radial portion 84A is a pivot arm 90. An arm connector 92A is pivotally attached at one end of the outer ends of the pivot arm 90 and, at the other end, is pivotally attached to arm 88A by a pin 94A. In like manner, an arm connector 92B is pivotally attached to the other end of the pivot arm 90 and by pin 94B to arm 88B.

A cylinder 96 is supported at one end to base member 84 by pin 98. Reciprocally extending from the cylinder 96 is piston rod 96A which is pivotally attached at its outer end by pin 100 to the inter-connection of pivot arm 90 and arm connector 92B.

Figure 8:
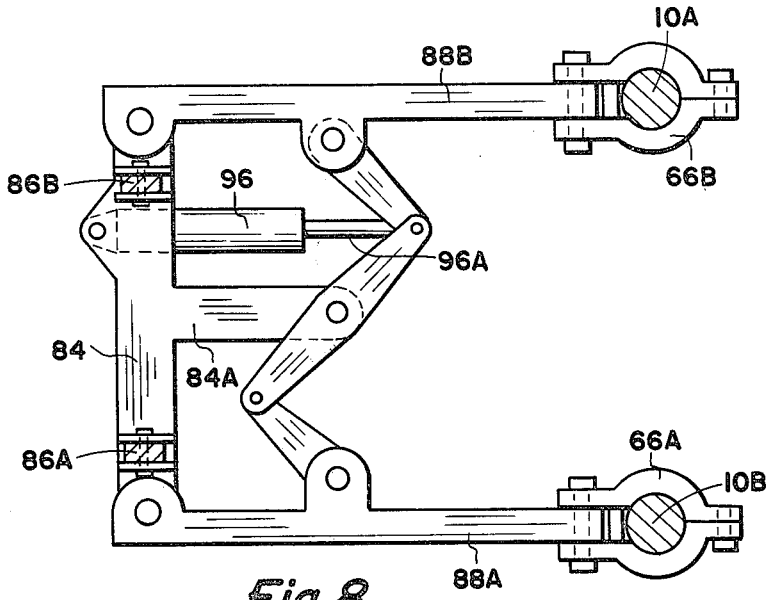
FIG. 8 is a cross-sectional view of a major portion of the link control arrangement of FIG. 7 as taken along the lines 8—8 of FIG. 7.
Figure 8A:
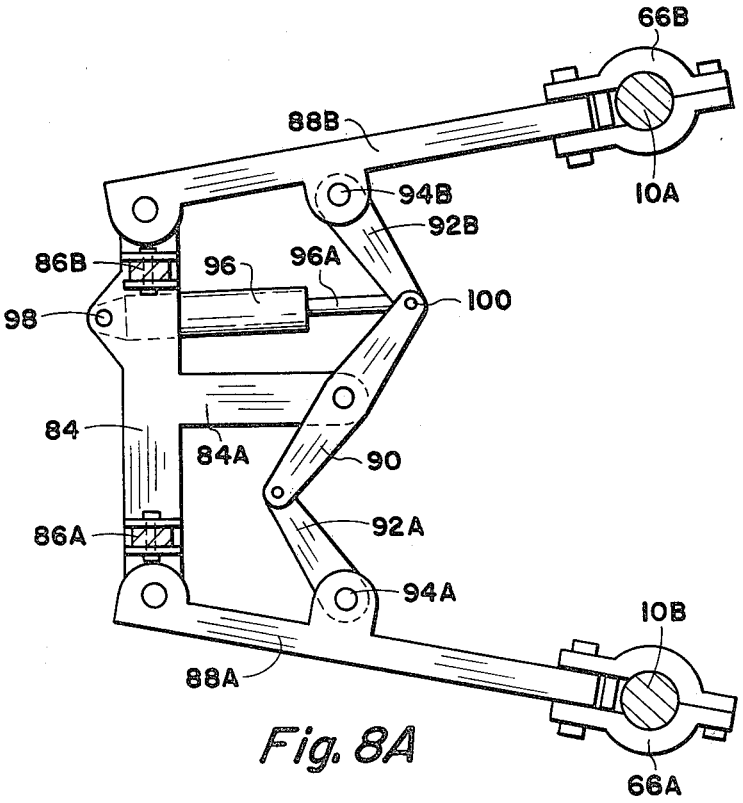
FIG. 8A is a cross-sectional view as in FIG. 8 but showing the links spread apart.

When piston rod 96A is extended, as shown in FIG. 8, pivot arm 90 is rotated to the position illustrated and arms 88A and 88B draw the links 90A and 90B to the vertical, parallel position. When the piston rod 96A is retracted, pivot arm 90 is rotated to the position as shown in FIG. 8A, moving the outer ends of arms 80A and 80B apart, and therefore moving the lower ends of links 10A and 10B apart.

Returning to FIG. 7, each of the suspension bars 86A and 86B has a radial integral portion (only the portion 86A' of bar 86A being seen). Extending between the outer end of the radial portions is a shaft 102. Parallel to it and extending between the horizontal portions of brackets 82A and 82B is a shaft 104. Pivotally supported to shaft 104 is a cylinder 106 having a piston rod 108 extending reciprocally therefrom. The piston rod is attached to shaft 102. When hydraulic pressure is applied to cylinder 106 to extend piston rod 108 the suspension bars 86A and 86B are pivoted as shown in dotted outline in FIG. 7. This pivotal movement is transferred to the base member 84 and thereby to arms 88A and 88B to thereby pivot the links 10A and 10B as shown in dotted outline. Thus, by the use of cylinders 96 and 106 in the embodiment of FIGS. 7, 8, and 9, the links can be moved towards or away from each other or pivoted in a common plane relative to the vertical to thereby employ the links for use with a dual elevator system.

Reference has previously been made to the dual elevator system as described in U.S. Pat. No. 3,063,509 and since this patent is incorporated herein by reference, further detailed description of the apparatus for shifting the elevators and the sequence of steps employed in tripping pipe into and out of a borehole utilizing the dual elevator system, is not repeated here.

Figures 7, 9:
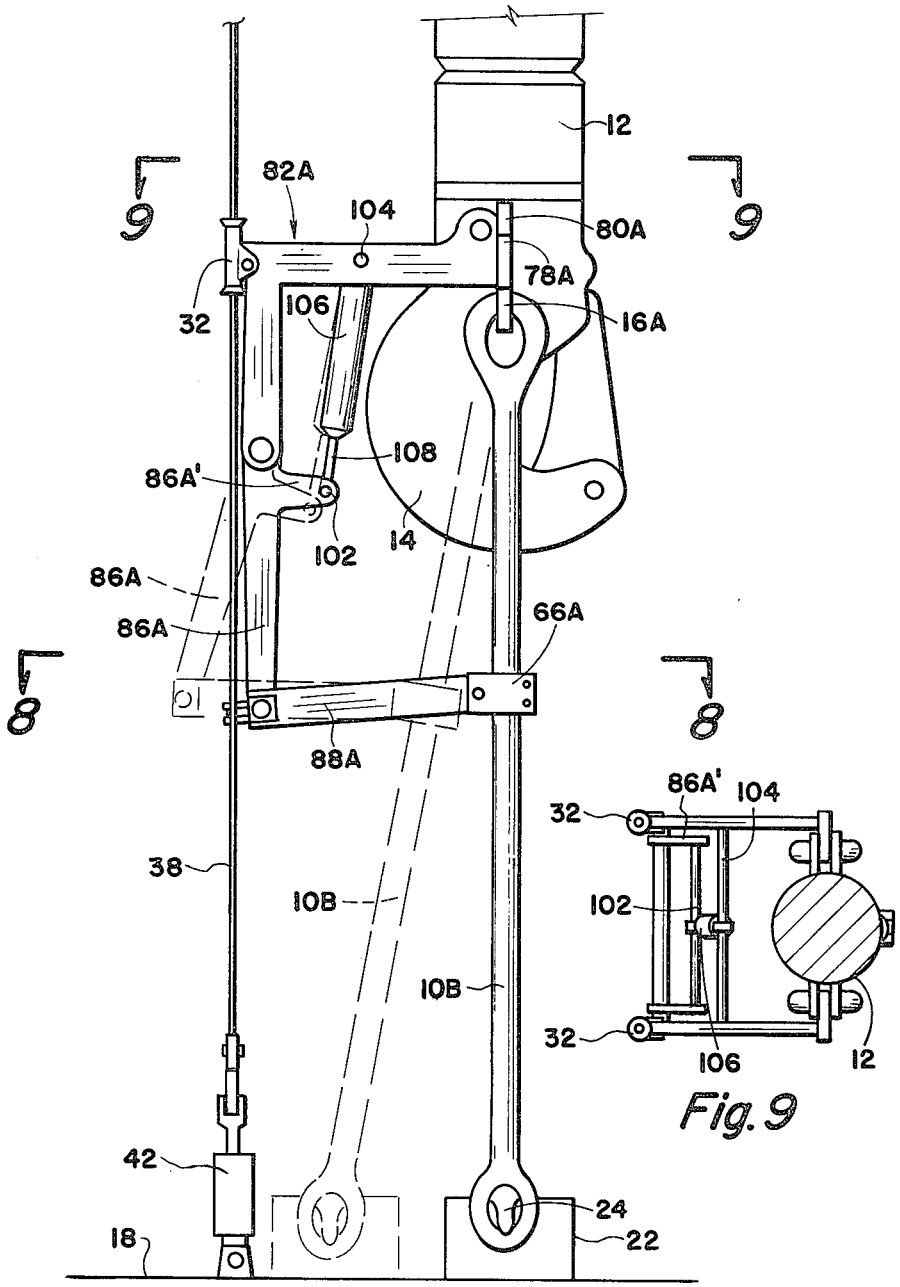
FIG. 7 is a side elevational view of another embodiment of the invention by which the links may be remotely controlled.
FIG. 9 is a cross-sectional view taken along the line 9—9 of FIG. 7 and showing a plan view of the link control system of FIGS. 7 and 8.

In the embodiment of FIGS. 1 through 6 and in FIGS. 7 through 9, hydraulically actuated cylinder-pistons are employed for controlling the links. The hydraulic fluid lines leading to the cylinder and the remote control valves for selectively applying hydraulic pressure to the lines and thereby to the cylinders are not shown since they are of standard design and would only encumber the drawings. The control valves are naturally located for convenient operation by the operator adjacent other derrick controls.

The improved link shift devices set forth herein substantially improve the performance of the use of dual elevators in oil and gas well drilling and leads to increased automation of drilling system.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element or step thereof is entitled.

What is claimed is:

1. An improved apparatus for handling stands of pipe in a drilling rig when connecting and disconnecting the stands in making up or pulling a drilling string employed in drilling a borehole wherein the drill pipe stands have enlarged tool joints providing shoulders thereon, the drilling rig having a rig floor over the borehole, comprising:

a lifting member elevationally positionable over a borehole;

a pair of links pivotally supported at their upper ends to said lifting member, the links have open loops at their lower ends;

means extending from said lifting member to selectively move said links so that their lower ends move towards or away from each other;

means extending from said lifting member to selectively pivot said links in a common plane from the vertical to an inclined angle;

means to guide said lifting means and thereby said links in vertical arrangement relative to a borehole;

horizontal elevator guide means positioned adjacent the borehole;

a pair of elevators slidably positionable on said elevator guide means, each elevator having opposed link attachment horns extending therefrom adaptable to receive the loops at the lower end of said links, each elevator having means to receive a length of drill pipe therein and to engage the drill pipe tool joint shoulders whereby each elevator may support a length of drill pipe;

means to shift said elevator in position on said guide to engage and support a string of drill pipe;

and means to laterally position the lower ends of said links to selectably engage or disengage the said elevator horns.

2. An improved apparatus for handling stands of pipe in a drilling rig according to claim 1 wherein said means to guide said lifting member and thereby said links in vertical alignment relative to a borehole includes:

a pair of guide members affixed to said lifting member; and a pair of paralleled vertical cables supported in the drilling rig and received in said guide members.

3. An improved apparatus for handling stands of pipe in a drilling rig according to claim 2 including:

means to selectably tension or slacken said cables.

4. An improved apparatus for handling stands of pipe in a drilling rig according to claim 3 wherein said means to selectably tension or slacken said cables includes:

a pair of hydraulic cylinders each having a piston therein and a piston rod extending reciprocally therefrom, a cylinder and piston rod being attached between the lower end of each cable and the rig floor; and means to control flow of hydraulic fluid to said cylinders to extend or retract said piston rods and to thereby tension or slacken said cables.

5. An improved apparatus for handling stands of pipe in a drilling rig according to claim 1 wherein said means extending from said lifting member to selectively move said links so that their lower ends move towards or away from each other and to selectively pivot the links in a common plane, comprises:

a downwardly depending U-shaped member pivotally supported at the upper end of the leg portions thereof to lifting member and providing an integral horizontal portion;

a horizontally extending U-shaped member having the ends of the leg portions thereof affixed to said downwardly depending U-shaped member intermediate the upper ends thereof and the said integral horizontal portion, the horizontal U-shaped member providing an integral intermediate portion;

a pair of hydraulic cylinders each having a reciprocal piston rod extending therefrom, a cylinder and piston rod being connected between said lifting member and the horizontal U-shaped member leg portions;

a triangular bracket having first, second, and third spaced apart pivot points, the first pivot point being pivotally supported to said downwardly depending U-shaped member horizontal portion;

an elevator engagement control hydraulic cylinder having a piston rod reciprocally extending therefrom connected between said horizontal U-shaped member intermediate portion and said bracket second pivot point;

a pair of bars each having one end pivotally secured to a said link at a point intermediate the link ends, the bars being in a common plane of the links, the upper end of each bar being pivotally attached to said triangular bracket whereby when said elevator engagement control hydraulic cylinder is actuated to extend the piston rod thereof, said triangular bracket is pivoted, which motion is conveyed to said bars to spread the lower ends of said links away from each other.

6. An improved apparatus for handling stands of pipe in a drilling rig according to claim 1 wherein said means extending from said lifting member to selectively move said link so that their lower ends towards or away from each other and to selectively pivot the links in a common plane, comprises:

a pair of brackets extending horizontally from said lifting member in paralleled, spaced relationship a horizontal base member supported below said brackets, the base member having an integral horizontal radial portion extending in the direction of an intermediate said links;

a suspension bar extending downwardly from each said bracket and pivotally supporting said base member, each suspension bar having a radially extending portion in the direction towards said links.

a pair of horizontal arms, each pivotally attached to opposite ends of said base member, the outer end of said arm being attached to a said link at a point intermediate the link ends;

a pivot arm pivotally attached at an intermediate point to the outer end of said base member intermediate portion and pivotal in a plane of said base member and said arms;

a pair of arm connectors pivotally attached at one end thereof to the opposite outer ends of said pivot arm, the outer end of each arm connector being pivotally attached to a said horizontal arm whereby said horizontal arms are simultaneously pivoted towards or away from each other when said pivot arm is rotated to thereby move the lower ends of said links towards and away from each other;

controllable means to rotate said pivot arm; and a cylinder having a piston rod extending reciprocally therefrom and having one end pivotally attached to said horizontal brackets, and the other end pivotally attached to said suspension bars radially extending portion whereby when said cylinder rod is extending said links are pivotally in a common plane.

7. An improved apparatus for handling stands of pipe in a drilling rig according to claim 6 wherein said controllable means to rotate said pivot arm includes:

a hydraulic cylinder having a piston rod extending reciprocally therefrom, having one end attached to said base member and the other end pivotally attached to said pivot arm.

* * * * *

UNITED STATES PATENT AND TRADEMARK OFFICE

CERTIFICATE OF CORRECTION

PATENT NO. : 4,326,745

DATED : April 27, 1982

INVENTOR(S) : William C. Guier

It is certified that error appears in the above-identified patent and that said Letters Patent are hereby corrected as shown below:

"Assignee: Guier and Affiliates, Inc., Tulsa, Oklahoma"

is hereby changed to:

--Assignee: Drill Tech Equipment, Inc., Tulsa, Oklahoma--

Signed and Sealed this

*Twenty-first* Day of *September 1982*

[SEAL]

*Attest:*

GERALD J. MOSSINGHOFF

*Attesting Officer*

*Commissioner of Patents and Trademarks*